US006794969B2

(12) United States Patent
Kim et al.

(10) Patent No.: US 6,794,969 B2
(45) Date of Patent: Sep. 21, 2004

(54) DEFLECTION YOKE FOR COMPENSATING MIS-CONVERGENCE

(75) Inventors: Chan Su Kim, Seoul (KR); Seung Wook Han, Suwon-Shi (KR)

(73) Assignee: Samsung Electro-Machanics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/409,383

(22) Filed: Apr. 8, 2003

(65) Prior Publication Data

US 2004/0108801 A1 Jun. 10, 2004

(30) Foreign Application Priority Data

Dec. 10, 2002 (KR) ..... 10-2002-78422

(51) Int. Cl.[7] ..... H01H 1/00; H01H 5/00

(52) U.S. Cl. ..... 335/213; 335/210; 313/440

(58) Field of Search ..... 335/210–214; 313/440

*Primary Examiner*—Ramon M. Barrera
(74) *Attorney, Agent, or Firm*—Darby & Darby

(57) ABSTRACT

The present invention discloses a deflection yoke for compensating mis-convergence which can compensate an error generated due to upper and lower side control unbalance during the YH compensation circuit operation by equalizing length of wires connected between upper and lower side coma free coils and connection terminals. In addition, the deflection yoke can compensate mis-convergence by compensating the error generated due to the upper and lower side control unbalance during the YH compensation circuit operation by serially connecting a resistor having a resistance value corresponding to wiring length difference of the upper and lower side coma free coils to a shorter wire.

8 Claims, 10 Drawing Sheets

DEFLECTION YOKE FOR COMPENSATING MIS-CONVERGENCE

BACKGROUND OF THE INVENTION

1. Field of the Invention

The present invention relates to a deflection yoke for compensating mis-convergence, and more particularly to a deflection yoke for compensating mis-convergence which can compensate an error generated due to upper and lower side control unbalance during the YH compensation circuit operation by equalizing length of wires connected between upper and lower side coma free coils positioned at a rear cover unit of the deflection yoke and connection terminals of a printed circuit board.

2. Description of the Related Art

In general, images which users watch on TV screen are not fixed images but consecutive still images displayed about 30 times per second. Colors displayed on the screen are combinations of electron beams radiated through red, blue and green phosphors coated on the screen surface of a cathode ray tube.

That is, one frame containing whole image information is formed by interlaced-scanning 525 scanning lines from the top left end of the screen to the bottom left end for 1/30 second, and intensity of electron beams is controlled and brightness of the screen is varied by using the fact that the electron beams become bright when severely colliding with the phosphor, thereby visualizing image signals. If the electron beams are not scanned in the aforementioned manner, one bright dot is generated at the center of the screen, and images are not normally transmitted.

A cathode ray tube and a deflection yoke are important means for reproducing video image signals transmitted through a camera on a display as images recognizable by users.

In spite of development of new display devices such as a liquid crystal display and plasma display panel, the cathode ray tube has been most widely used because of high display quality and cost to performance rate.

In general, the cathode ray tube includes the deflection yoke which precisely irradiates three color electron beams from electron guns to a phosphor film coated on the screen surface of the cathode ray tube by deflection.

The deflection yoke which is the most important means of the magnetic devices of the cathode ray tube serves to reproduce electric signals transmitted in time series as images on the screen of the cathode ray tube.

That is, the electron beams from the electron guns go straight toward the screen due to high voltage, and thus radiate only the center phosphor of the screen. Here, the deflection yoke externally deflects the electron beams to reach the screen in the scanning order. The deflection yoke precisely deflects the electron beams to the phosphor film coated on the screen of the cathode ray tube by forming a magnetic field, and using the fact that the direction of the electron beams is changed because the electron beams pass through the magnetic field and receive an electromagnetic force.

FIG. 1 is a side diagram illustrating a general cathode ray tube. Referring to FIG. 1, a deflection yoke 104 is positioned in an RGB electron gun unit 103 of a cathode ray tube 100, for deflecting electron beams from electron guns 103*a* to a phosphor film coated on a screen surface 102.

The phosphor of the phosphor film transforms electron energy to light due to collision of the electron beams. Selection and coating of phosphor are important to obtain appropriate colors, durability and long life span.

The deflection yoke 104 includes a pair of coil separators 110 which are upper and lower side symmetrical and combined into one. The coil separator 110 insulates a horizontal deflection coil 115 and a vertical deflection coil 116 as well as appropriately fixes their positions. The coil separator 110 includes a screen unit 111*a* coupled with the screen surface 102, a rear cover unit 111*b*, and a neck unit 112 extended from the center of the rear cover unit 111*b* and coupled with the electron gun unit 103 of the cathode ray tube 100.

The horizontal deflection coil 115 and the vertical deflection coil 116 for forming a horizontal deflection magnetic field and a vertical deflection magnetic field with external power are installed on the inner and outer circumferences of the coil separator 110.

A pair of ferrite cores 114 composed of a magnetic material for enhancing the magnetic field generated from the vertical deflection coil 116 are mounted to surround the vertical deflection coil 116.

A printed circuit board p is installed at one side of the rear cover unit 111*b* of the coil separator 110, for controlling electric signals for the deflection yoke through a few circuit elements, by for example, supplying power to the horizontal and vertical deflection coils 115 and 116.

When different frequency saw tooth waves are applied to the horizontal and vertical deflection coils 115 and 116, under the Fleming's left-hand law, the horizontal deflection coil 115 generates a magnetic force line in the vertical direction so that the electron beams receive force in the horizontal direction, and the vertical deflection coil 116 generates a magnetic force line in the horizontal direction so that the electron beams receive force in the vertical direction. Accordingly, red, green and blue electron beams R, G and B from the electron guns 113*a* are deflected at a predetermined angle to determine scanning positions on the screen.

On the other hand, the deflection yoke of FIG. 1 is classified into a saddle—saddle type of FIGS. 2 and 3 and a saddle-toroidal type (not shown) according to winding structure of coils.

In the saddle—saddle type deflection yoke as shown in FIGS. 2 and 3, a saddle type horizontal deflection coil 115 is installed at the upper and lower sides of the inner circumference of a screen unit 111*a* of a conical coil separator 110, and a saddle type vertical deflection coil 116 is installed at the right and left sides of the outer circumference thereof. In addition, a cylindrical ferrite core 114 is installed on the outer circumference of the screen unit 111*a* of the coil separator 110 to enhance a magnetic field of the vertical deflection coil 116.

Coma free coils (not shown) for compensating coma generated by the vertical deflection coil 116 are positioned around the outer circumference of a neck unit 112 of the coil separator 110.

In the saddle-toroidal type deflection yoke, a saddle type horizontal deflection coil 115 is installed at the upper and lower sides of the inner circumference of a screen unit of a conical coil separator 110, a cylindrical ferrite core 114 is disposed on the outer circumference thereof, and a toroidal type vertical deflection coil 116 is wound along the upper and lower sides of the ferrite core 114.

Coma free coils (not shown) for compensating coma generated by the vertical deflection coil 116 are positioned around the outer circumference of a neck unit 112 of the coil separator 110.

A printed circuit board p is installed at one side of a rear cover unit 111*b* of the coil separator 110, for controlling electric signals for the deflection yoke through a few circuit elements, by for example, supplying power to the horizontal and vertical deflection coils 115 and 116.

On the other hand, in the saddle—saddle type or saddle-toroidal type deflection yoke, different magnetic fields are generated at both sides of the vertical and horizontal deflection coils installed to face each other due to distribution properties and relative current amount variations of the deflection coils.

In this case, three color electron beams initially emitted from the neck unit of the coil separator, namely the neck unit extended from the rear cover unit and coupled with the electron gun unit of the cathode ray tube show different vector trajectories due to positions of the red, green and blue electron guns and magnetic field difference generated from the deflection coils, which generates mis-convergence on the screen.

In order to precisely form images on a color monitor or cathode ray tube, the electron beams from the red, green and blue electron guns of the cathode ray tube should converge on one point at the same time. Mis-convergence of the red and blue electron beams from the green beam is measured.

When mis-convergence occurs, characters or pictures overlap with each other on the screen or are not clearly displayed. Mostly, mis-convergence becomes more serious at the edges of the screen than the center of the screen in the structure of the cathode ray tube.

In general, mis-convergence generated on the screen include a landing error, distortion error, VCR distortion, HCR, YV, YH, CV and PQH.

The landing error implies narrow or wide mis-convergence where the electron beams R, G and B from the electron guns are not precisely scanned to each pixel of the screen but deflected into the center or edges of the screen.

The distortion error implies barrel or pin type mis-convergence where the electron beams B, G and R pass the upper and lower sides of the screen, or are scanned merely to the center of the screen, not the edges of the screen.

As shown in FIG. 4, HCR implies horizontal unbalance mis-convergence. Here, the red beam R and the blue beam B are precisely scanned to the screen, but the green beam G is not precisely scanned to each pixel of the screen and generates an error in the horizontal direction. Therefore, the green beam G is positioned inside or outside the red beam R and the blue beam B. In this case, in order to prevent inductance difference in the upper and lower side horizontal deflection coils, the inductance is controlled by additionally installing a balance coil BC and moving a core of the balance coil BC.

As depicted in FIG. 5, VCR implies vertical unbalance mis-convergence. When a white line is displayed in the horizontal direction along the upper and lower sides of the screen, the red beam R and the blue beam B are precisely scanned to the screen, but the green beam B is not precisely scanned to each pixel of the screen and generates an error in the vertical direction. The VCR distortion is mostly generated at the upper and lower sides of the screen, but does not influence the center of the screen.

The coma free improves VCR (Ver. Center Raster) property of the deflection yoke, namely mis-convergence sensitivity of the centers of the red beam R/blue beam B and the vertical direction of the green beam G on the measurement point of the vertical axis of the cathode ray tube. The pin magnetic field generated from the coma free offsets the barrel magnetic field generated from the vertical deflection coil, so that the green beam G can match with the red beam R and the blue beam B.

In addition, CV implies mis-convergence where the red beam R and the blue beam B are alternately scanned in the vertical direction at the corners of the screen, and YV implies vertical mis-convergence where, when the screen is divided by X axis and Y axis, the horizontal line of the red beam R does not match with the horizontal line of the blue beam B at the upper and lower sides of the Y axis. In this case, relative intensity of current flowing to the right and left sides of the vertical deflection coil is adjusted by connecting variable resistors to the right and left side vertical deflection coils and controlling the variable resistors.

On the other hand, as shown in FIG. 7, YH implies mis-convergence where the vertical line of the red beam R and the vertical line of the blue beam B cross each other, which relates to axial properties of the screen. That is, mis-convergence of the vertical line of the blue beam B from the red beam R is measured at the upper and lower ends of the center of the screen. When the vertical line of the blue beam B mis-converges into the left side from the red beam R, it is marked as '−', and when the vertical line of the blue beam B mis-converges into the right side from the red beam R, it is marked as '+'.

It can be overcome by using a mis-convergence compensation circuit of FIG. 8.

FIG. 8 is a circuit diagram illustrating the conventional mis-convergence compensation circuit for the deflection yoke, and FIGS. 9 to 11 are exemplary screen diagrams showing YH distortion and a process for compensating the YH distortion.

Referring to FIG. 8, first and second coma free coils 51 and 52 are electrically connected in series to a vertical coil main unit 10.

An YHC mis-convergence control unit R1 and YHC VR is connected in parallel to the first and second coma free coils 51 and 52, for controlling mis-convergence on the screen by adjusting a relative amount of current flowing through the first and second coma free coils 51 and 52.

In addition, third and fourth coma free coils 53 and 54 are connected in parallel to the second coma free coil 52, and a variable resistor YH VR for controlling YH mis-convergence is connected in parallel to the third and fourth coma free coils 53 and 54.

The variable resistor YH VR for controlling YH mis-convergence serves to control mis-convergence on the screen by adjusting a relative amount of current flowing through the third and fourth coma free coils 53 and 54.

Moreover, first and second diodes D1 and D2 are connected in parallel to each other to have inverse polarity. The YH variable resistor YH VR is connected between a cathode terminal of the first diode D1 and an anode terminal of the second diode D2, and second and third resistors R2 and R3 connected in series to each other are connected in parallel to the YH variable resistor YH VR.

A fourth resistor R4 is connected to a connection node of the second and third resistors R2 and R3 and a connection node of the first and second diodes D1 and D2, and first and second coils (no reference numerals) are connected in parallel to the fourth resistor R4.

Accordingly, a voltage inputted by controlling a vertical deflection magnetic field amount through the vertical coil main unit 10 is inputted to the first and second coma free coils 51 and 52. YH mis-convergence generated on the screen is YH-compensated by the variable resistor YH VR. In this case, when the same current is not applied to the upper side coma free coil and the lower side coma free coil, a magnetic field deviation is generated not to normally compensate mis-convergence at the upper and lower sides of the screen.

As a result, YHC (YH cross) which implies unbalance is generated. The YHC mis-convergence control unit R1 and YHC VR controls mis-convergence on the screen by adjusting the relative amount of current flowing through the first and second coma free coils 51 and 52.

The conventional mis-convergence compensation circuit for the deflection yoke must compensate YH distortion of FIG. 9 which is one of the screen distortions in DY mounted on a monitor circuit for deflecting the beams.

In FIG. 8, an absolute amount of YH elements is compensated by controlling the variable resistor YH VR. In the case that the variable resistor YH VR is controlled to compensate YH, the upper and lower side property variations must be equalized. However, current cannot be identically applied or controlled due to resistance deviation generated by length difference of wires connected between the upper and lower side coma free coils and connection terminals of the printed circuit board. Accordingly, the identical variations are not obtained on the screen during the YH compensation, thereby mismatching the upper and lower side red and blue beams.

FIG. 10 shows such an unbalance state. The unbalance generated during the YH compensation is called YHC (YH cross).

Unnecessary operations are performed during the production due to YHC. In addition, it influences the other properties during the compensation. YHC is a common problem of the 'U' type method which is the main stream of the DY coma free coils, and thus needs to be urgently solved.

In order to solve the foregoing problems, the conventional deflection yoke generates a reverse signal as shown in FIG. 11 by controlling the variable resistor YHC VR for compensating YHC distortion as shown in FIG. 8. Thus, entire compensation is performed by YH combinations of FIGS. 9 and 11.

However, because the coma free coils are connected to the YH variable resistor YH VR, the amount of current flowing through the upper and lower side coma free coils is adjusted due to the control of the YH variable resistor YH VR, which changes the absolute amount of the YH elements on the screen.

Accordingly, when the compensation of the YH variable resistor YH VR is not uniformly controlled at the upper and lower sides, the YHC variable resistor YHC VR must be re-compensated on the circuit.

In order to solve the aforementioned problem, some cathode ray tubes employ 'E' type coma free coils. However, the 'E' type method complicates wiring, increases expenses, and deteriorates electromagnetic properties due to the complicated wiring.

SUMMARY OF THE INVENTION

It is, therefore, an object of the present invention to provide a deflection yoke for compensating mis-convergence which can compensate an error generated due to upper and lower side control unbalance during the YH compensation circuit operation by equalizing length of wires connected between upper and lower side coma free coils of the deflection yoke and connection terminals of a printed circuit board.

Another object of the present invention is to provide a deflection yoke for compensating mis-convergence which can compensate an error generated due to upper and lower side control unbalance during the YH compensation circuit operation by serially connecting a resistor corresponding to length difference of wires connected between upper and lower side coma free coils of the deflection yoke and connection terminals of a printed circuit board to the upper side coma free coil adjacent to the printed circuit board.

To achieve the above objects, there is provided a deflection yoke for compensating mis-convergence including: a coil separator, a printed circuit board being positioned at one side of a rear cover unit of which; deflection coils installed respectively on the inner and outer circumferences of the coil separator, for generating magnetic fields to deflect electron beams irradiated from a cathode ray tube; ferrite cores installed on the outer surface of the coil separator for enhancing the magnetic fields of the deflection coils; and coma free coils for compensating mis-convergence generated due to length difference of both side wires by extending the wire connected between one side coma free coil adjacent to connection terminals of the printed circuit board and the connection terminals to have the same length as the wire connected between the other side coma free coil installed to face one side coma free coil at a predetermined distance and the connection terminals.

According to another aspect of the present invention, in order to equalize length of the wires between the connection terminals and both side coma free coils, one side line of the coma free coil adjacent to the connection terminals of the printed circuit board is wired to the corresponding connection terminal at a short distance, and the other side line of the coma free coil is wired to the corresponding connection terminal at a long distance by passing a bobbin of the facing coma free coil.

According to yet another aspect of the present invention, in order to equalize length of the wires between the connection terminals and both side coma free coils, both side input/output wires of the coma free coil adjacent to the connection terminals of the printed circuit board are extended and wired at the same time.

According to yet another aspect of the present invention, hooking units are formed symmetrically in the right/left direction at predetermined peripheral regions on which the coma free coils are mounted from a center extension line vertically dividing the coma free coils into two, and the wires are wound around the hooking units, whereby both side wires are symmetrical.

According to yet another aspect of the present invention, at least one hooking unit is formed at one of the symmetrical sides.

According to yet another aspect of the present invention, a deflection yoke for compensating mis-convergence includes: a coil separator, a printed circuit board being positioned at one side of a rear cover unit of which; deflection coils installed respectively on the inner and outer circumferences of the coil separator, for generating magnetic fields to deflect electron beams irradiated from a cathode ray tube; ferrite cores installed on the outer surface of the coil separator for enhancing the magnetic fields of the deflection coils; and coma free coils for serially connecting a resistor having a resistance value corresponding to length difference of a wire connected between one side coma free coil adjacent to connection terminals of the printed circuit board and the connection terminals and a wire connected between the other side coma free coil installed to face one side coma free coil at a predetermined distance and the connection terminals to the wire connected between one side coma free coil adjacent to the connection terminals and the connection terminals to compensate mis-convergence generated due to length difference of the wires.

According to yet another aspect of the present invention, the resistor is mounted on the printed circuit board, and the resistance value of the resistor is 0.07 Ω.

BRIEF DESCRIPTION OF THE DRAWINGS

The above objects, features and advantages of the present invention will become more apparent from the following detailed description when taken in conjunction with the accompanying drawings, in which.

DETAILED DESCRIPTION OF THE PREFERRED EMBODIMENT

Figure 1:
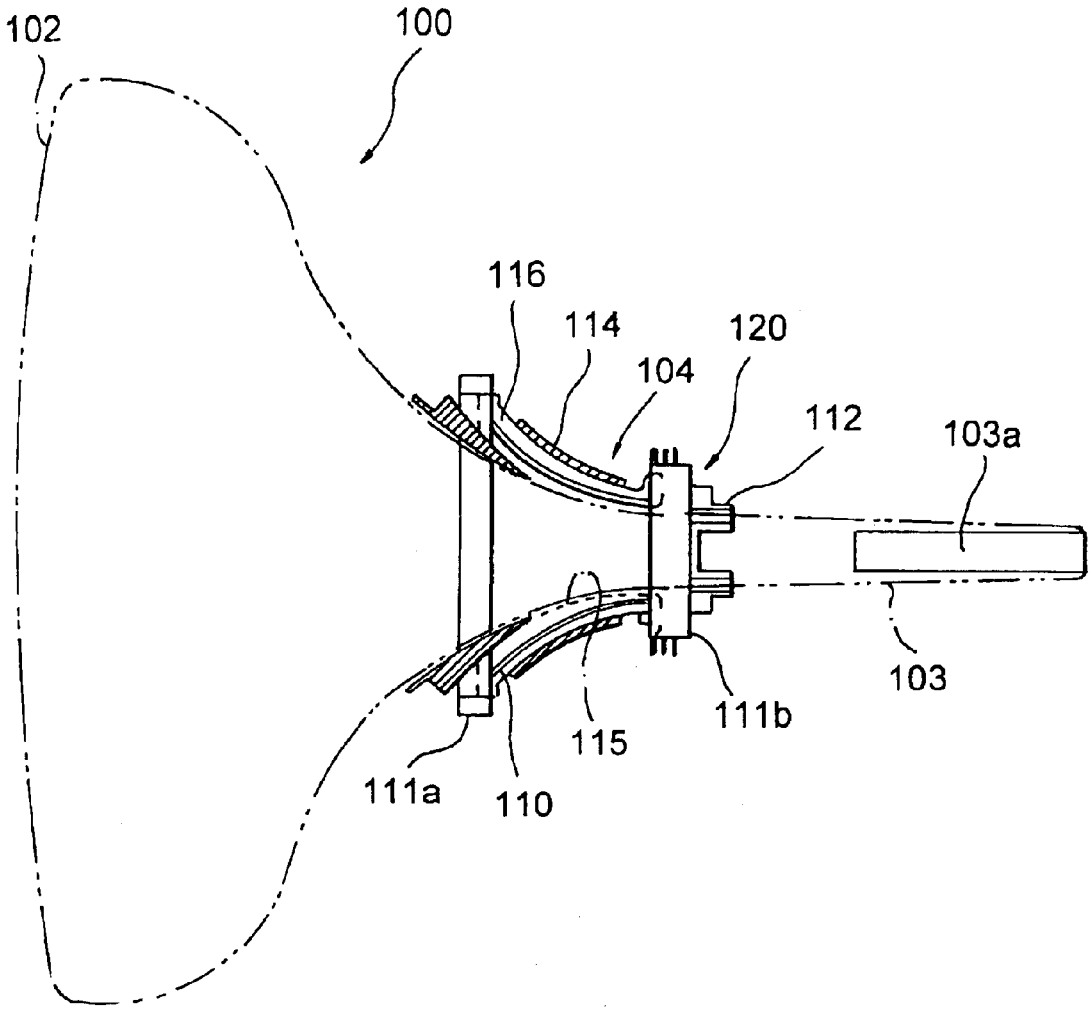
FIG. 1 (Conventional Art)
FIG. 1 is a side diagram illustrating a general cathode ray tube.
Figure 2:
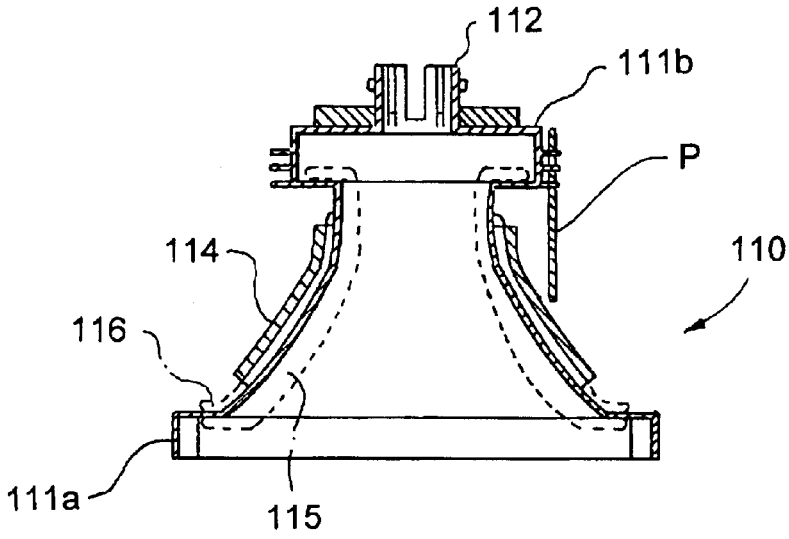
FIG. 2 (Conventional Art)
FIG. 2 is a front-sectional diagram illustrating a conventional saddle—saddle type deflection yoke.
Figure 3:
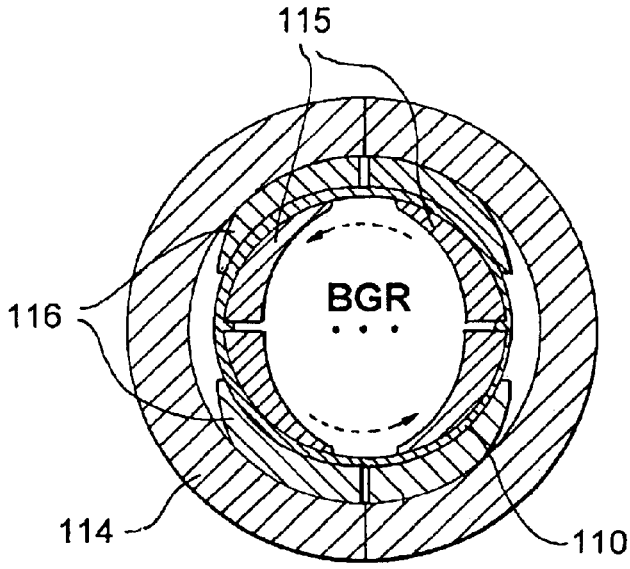
FIG. 3 (Conventional Art)
FIG. 3 is a plane-sectional diagram of FIG. 2.
Figure 4:
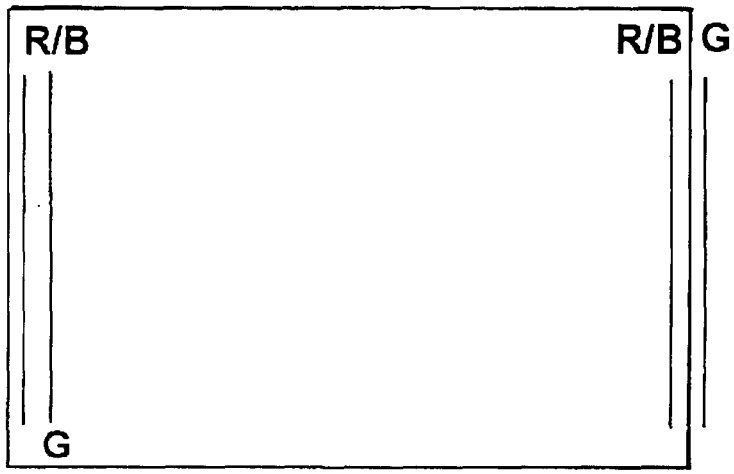
FIG. 4 (Conventional Art)
FIGS. 4 to 7 are exemplary diagrams respectively illustrating patterns of mis-convergence generated on the screen of the conventional deflection yoke.
Figure 5:
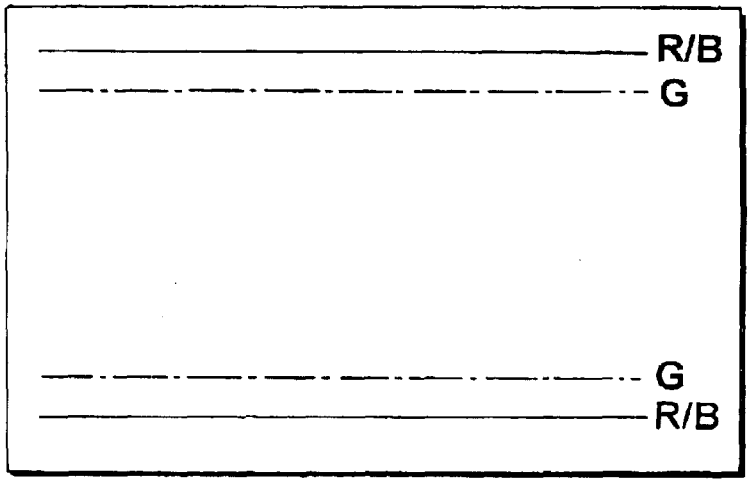
FIG. 5 (Conventional Art)
Figure 6:
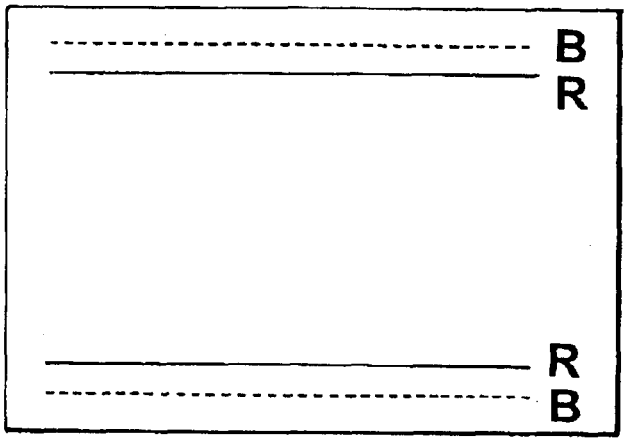
FIG. 6 (Conventional Art)
Figure 7:
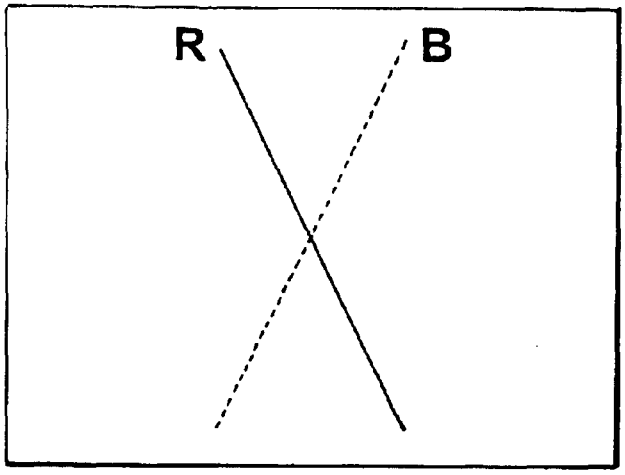
FIG. 7 (Conventional Art)

Preferred embodiments of the present invention will now be described with reference to the accompanying drawings. In the following description, same drawing reference numerals are used for the same elements even in different drawings. The matters defined in the description such as a detailed construction and elements of a circuit are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 12:
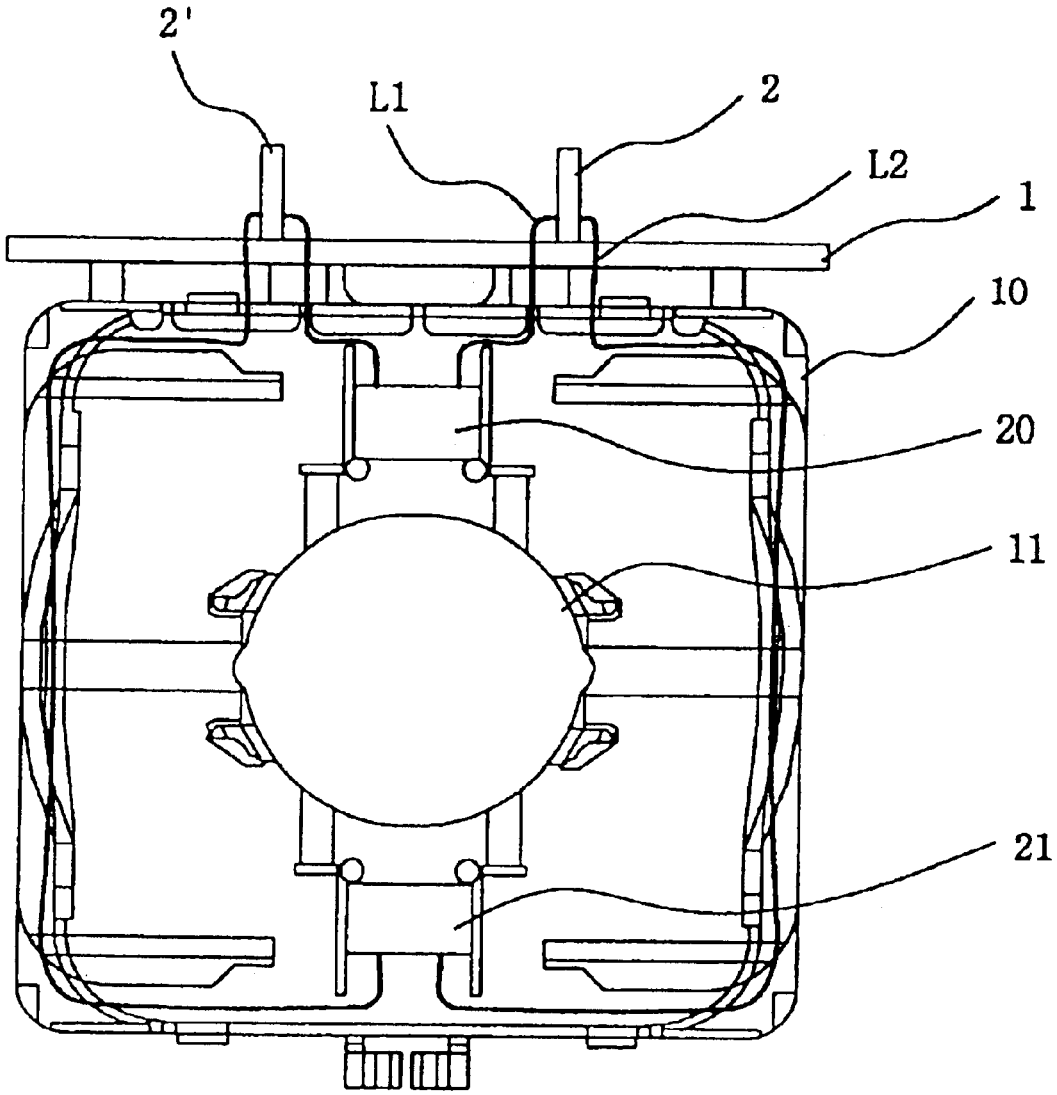
FIG. 12 (Conventional Art)
FIG. 12 is a schematic diagram illustrating general wiring between connection terminals of a printed circuit board and coma free coils for compensating mis-convergence.

FIG. 12 is a schematic diagram illustrating general wiring between connection terminals of a printed circuit board and coma free coils for compensating mis-convergence. A deflection yoke includes a pair of coil separators which are upper and lower side symmetrical and combined into one. The coil separator insulates a horizontal deflection coil and a vertical deflection coil as well as appropriately fixes their positions. The coil separator includes a screen unit coupled with the screen surface of a cathode ray tube, a rear cover unit, and a neck unit extended from the center of the rear cover unit and coupled with an electron gun unit of the cathode ray tube.

The horizontal deflection coil and the vertical deflection coil for forming a horizontal deflection magnetic field and a vertical deflection magnetic field with external power are installed on the inner and outer circumferences of the coil separator. A pair of ferrite cores composed of a magnetic material for enhancing the magnetic field generated from the vertical deflection coil are mounted to surround the vertical deflection coil.

A printed circuit board on which a circuit for compensating mis-convergence is mounted is installed at one side of the rear cover unit of the deflection yoke. As illustrated in FIG. 12, the printed circuit board 1 is installed on the top surface of the rear cover unit 10 of the coil separator.

The printed circuit board 1 is a board on which electronic components are installed, and composed of tempered glass fiber or plastic. Generally, the electronic components are mutually connected through a copper circuit. In some systems, the major printed circuit board is called a system board or mother board, and small components mounted on slots of the mother board are called slaves or cards. The term 'Print' implies that complicated circuits are clearly engraved on the board.

A general printed circuit board process will now be briefly explained. A copper thin film is put on a tempered glass fiber or plastic board, and photoresist is covered thereon. When light is irradiated on the photoresist through a circuit-engraved negative film, only hardened portions are left after etching (erosion of copper plate). When the resulting structure passes through an electrolytic bath containing strong acid, non-hardened parts are washed, to complete the printed circuit board.

The printed circuit board 1 includes connection terminals 2 and 2' for transmitting current to the vertical and horizontal deflection coils and the coma free coils 20 and 21. I/O lines of the coma free coils 20 and 21 are connected respectively to the connection terminals 2 and 2'. Here, it should be recognized that the connection terminals 2 and 2' of the printed circuit board 1 are illustrated to explain the wiring structure between the coma free coils 20 and 21 and the printed circuit board 1. Thus, more connection terminals can be positioned on the printed circuit board 1.

The coma free coils 20 and 21 are installed to correspond to the upper and lower sides of the rear cover unit 10 of the coil separator in the upper and lower directions of the neck unit 11 of the coil separator which is a path through which electron beams are initially emitted.

In order to preferably compensate mis-convergence, a number of windings and a winding direction of the upper and lower side coma free coils 20 and 21 on cores are determined in consideration of a magnetic field size and direction by current.

On the other hand, wiring distances between the coma free coils 20 and 21 and the connection terminals 2 and 2' are different due to locations of the coma free coils 20 and 21 at the upper and lower sides.

That is, as shown in FIG. 12, a wire L1 connected between the coma free coil 20 adjacent to the connection terminals 2 and 2' of the printed circuit board 1 and the connection terminals 2 and 2' and a wire L2 connected between the lower side coma free coil 21 and the connection terminals 2 and 2' have length difference of 'L2–L1'.

Accordingly, wires are regarded as resistors in the deflection yoke using radio frequency. In the case of the coma free coils 20 and 21 whose upper and lower sides are wound in the same winding number, the difference of resistance values generated due to wiring length difference to the connection terminals 2 and 2' cannot be ignored. In this embodiment, the resistance value generated due to the wiring length difference is measured to be about 0.07 Ω by experiment.

Table 1 shows YH absolute amount measured by YH control and YHC (YH Cross) which implies unbalance, when YH distortion is compensated in the deflection yoke having the aforementioned wiring structure where the upper side coma free coil 20 and the lower side coma free coil 21 have wiring length difference.

TABLE 1

| | | | | | | | |
|---|---|---|---|---|---|---|---|
| YH | −0.20 | −0.15 | −0.05 | 0 | 0.05 | 0.15 | 0.20 |
| YH(upper) | −0.30 | −0.20 | −0.07 | 0 | 0.06 | 0.22 | 0.31 |

TABLE 1-continued

| | | | | | | | |
|---|---|---|---|---|---|---|---|
| YH(lower) | −0.10 | −0.10 | −0.03 | 0 | 0.04 | 0.08 | 0.09 |
| YHC | 0.20 | 0.10 | 0.04 | 0 | 0.02 | 0.14 | 0.22 |

In Table 1, YH(upper) shows distance difference of a blue beam (B) from a red beam (R) at the top end of the screen, and YH(lower) shows distance difference of the blue beam (B) from the red beam (R) at the bottom end of the screen.

In Table 1, YH(upper) shows distance difference of a blue beam (B) from a red beam (R) at the top end of the screen, and YH(lower) shows distance difference of the blue beam (B) from the red beam (R) at the bottom end of the screen.

Minus '−' implies that the vertical line of the blue beam (B) is deflected into the left side from the red beam (R), and plus '+' implies that the vertical line of the blue beam (B) is deflected into the right side from the red beam (R).

YH represents an average of two values, namely YH (upper) and YH (lower), and YHC represents YH cross at the upper and lower sides during the YH compensation.

For example, when YH (upper) is −0.30 (unit: mm) and YH (lower) is −0.10 in Table 1, YH is the average of two values, namely −0.20, and YHC is the absolute value thereof, namely 0.20.

Figure 8:
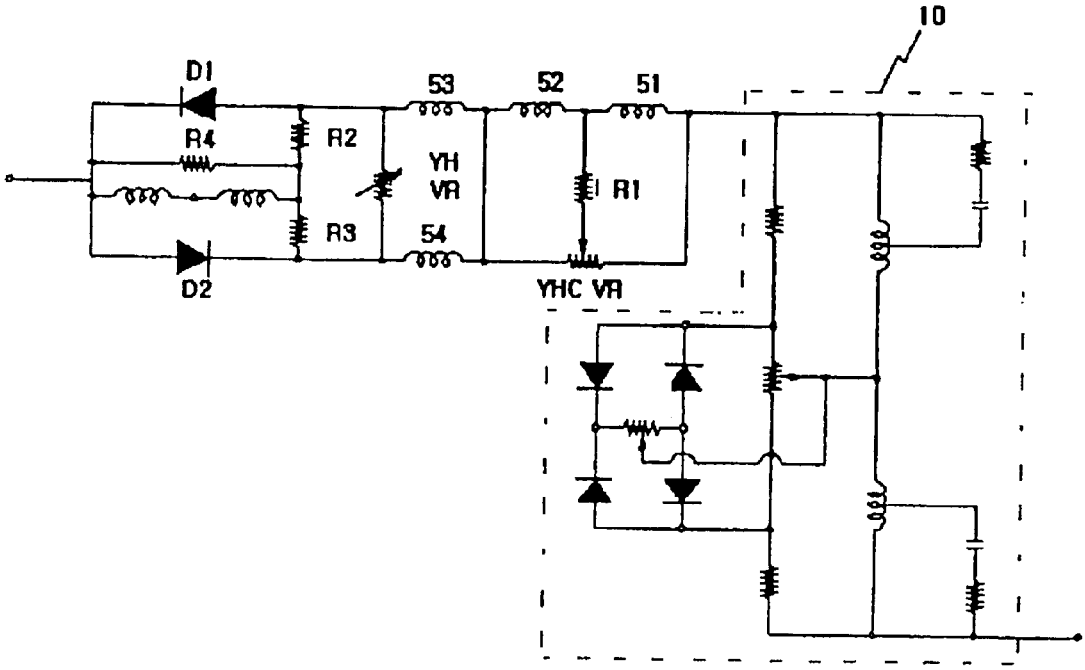
FIG. 8 (Conventional Art)
FIG. 8 is a circuit diagram illustrating a mis-convergence compensation circuit of the general deflection yoke.
Figure 9:
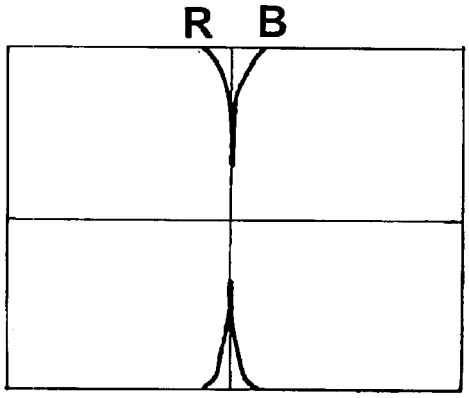
FIG. 9 (Conventional Art)
FIGS. 9 to 11 are exemplary diagrams respectively illustrating YH distortion and a process for compensating the YH distortion.
Figure 10:
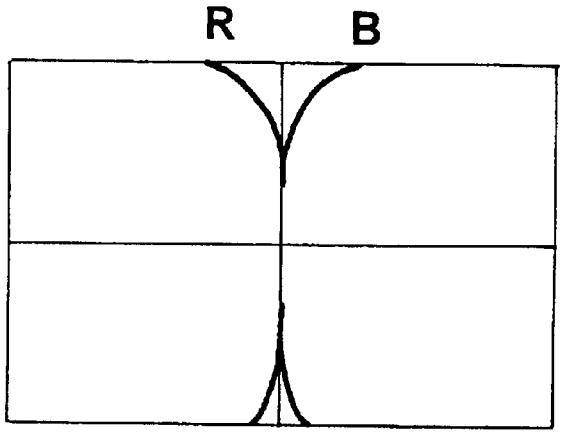
FIG. 10 (Conventional Art)
Figure 11:
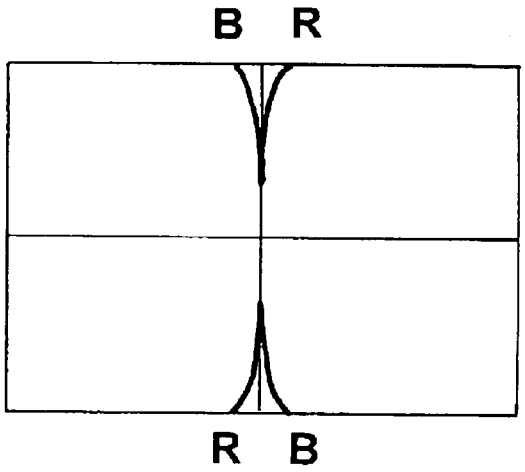
FIG. 11 (Conventional Art)

As shown in Table 1, YH variations are greater at the upper side than the lower side according to variations of the YH absolute amount. Such a difference increases according to the control operation, to increase YHC. That is, the YH compensation is not balanced at the upper and lower sides. As a result, the YHC should be re-compensated by the mis-convergence compensation circuit of FIG. 8.

The unbalance between the upper and the lower sides results from the wiring resistance difference between both side coma free coils 20 and 21 in the general wiring structure.

Therefore, the present invention starts from the fact that unbalance can be overcome by equalizing the resistance value between the upper side coma free coil 20 and the connection terminals 2 and 2' and the resistance value between the lower side coma free coil 21 and the connection terminals 2 and 2'.

Figure 13:
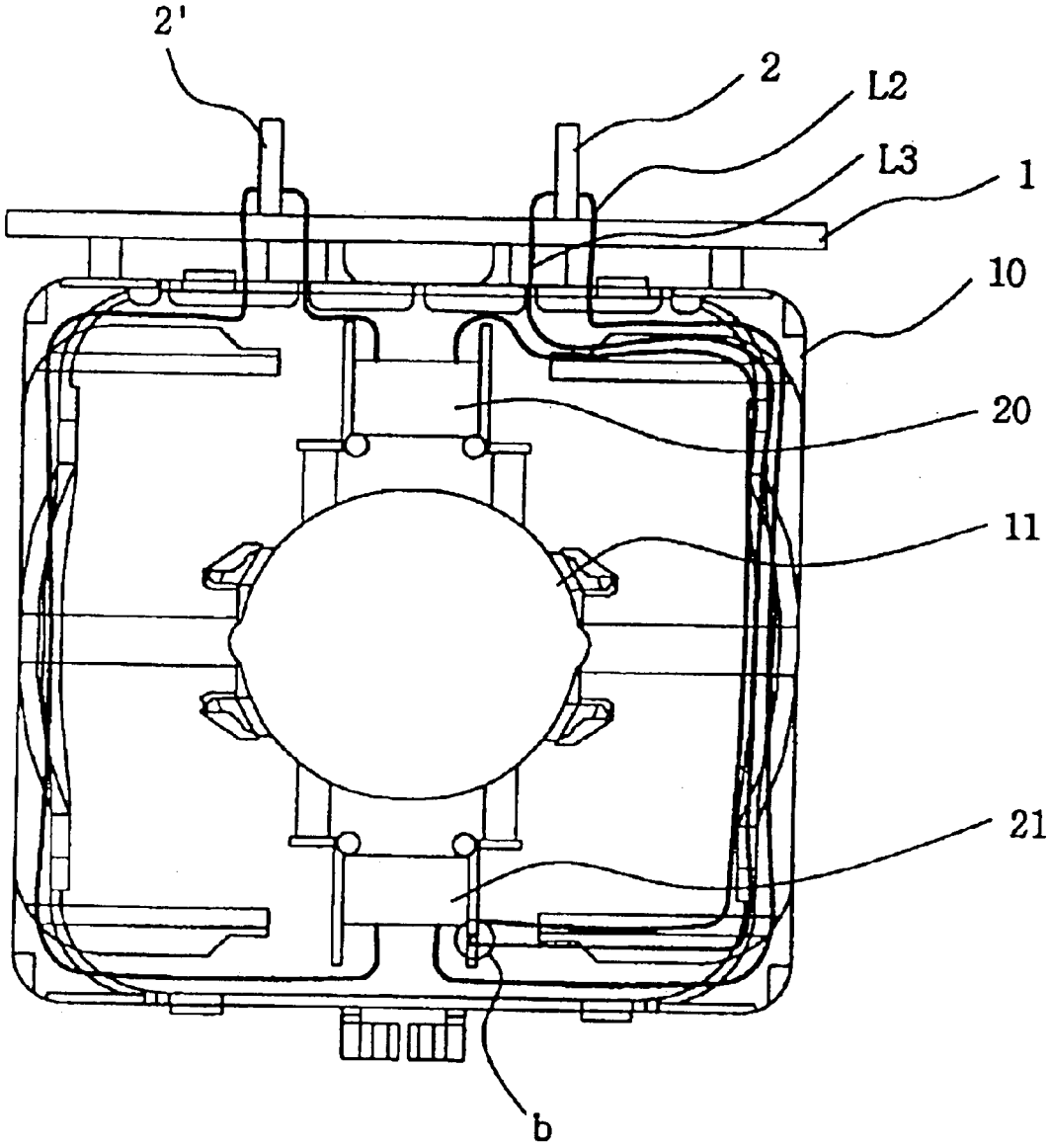
FIG. 13 is a schematic diagram illustrating a wiring structure for compensating mis-convergence in a deflection yoke in accordance with a first embodiment of the present invention.

FIG. 13 is a schematic diagram illustrating a wiring structure of coma free coils in a deflection yoke for compensating mis-convergence in accordance with one preferred embodiment of the present invention.

Referring to FIG. 13, one side line of an upper side coma free coil 20 adjacent to a printed circuit board 1 is wound around a coil bobbin b of a lower side coma free coil 21 one time, and then connected to a connection terminal 2. Accordingly, the total wiring length L3 of the coma free coil 20 adjacent to the connection terminals 2 and 2' is identical to the total wiring length of the coma free coil 21 installed at the lower side to face the coma free coil 20.

Here, one side line of the coma free coil 20 wound around the coil bobbin b and adjacent to the connection terminals 2 and 2' is selected from a line through which current is inputted from the connection terminals 2 and 2' to the coma free coil 20 and a line through which current is outputted from the coma free coil 20 to the connection terminals 2 and 2'. In this embodiment, one side line is wired in the right direction, but can be wired in the left direction.

Preferably, a number of winding the coma free coil 20 around the coil bobbin b is set up to equalize the total wiring length of the coma free coil 20 adjacent to the connection terminals 2 and 2' to the total wiring length of the coma free coil 21 located at a long distance.

Figure 14:
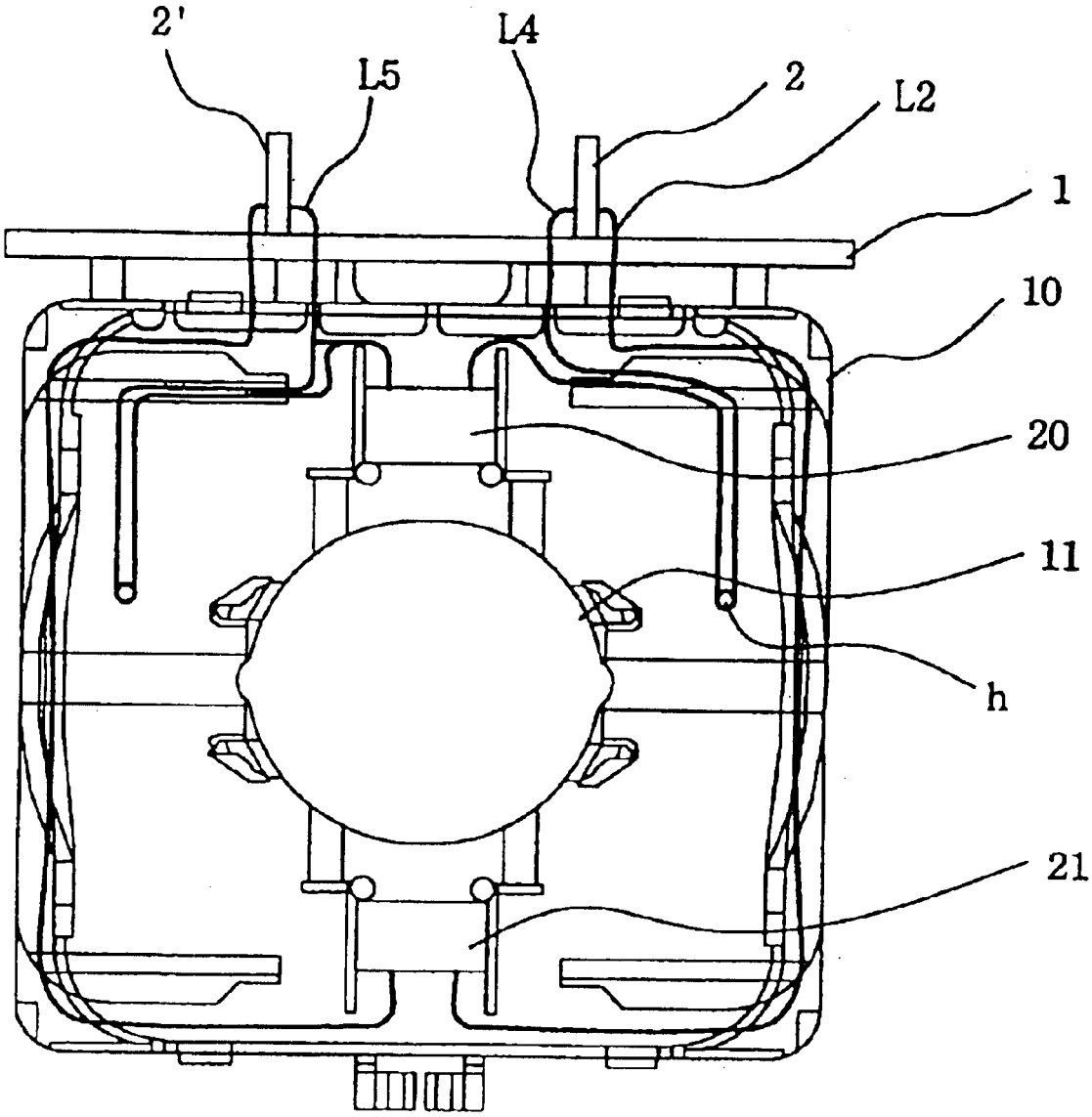
FIG. 14 is a schematic diagram illustrating a wiring structure for compensating mis-convergence in the deflection yoke in accordance with a second embodiment of the present invention.

FIG. 14 is a schematic diagram illustrating a wiring structure for respectively extending both side lines of the coma free coil 20 adjacent to the connection terminals 2 and 2' in accordance with another embodiment of the present invention.

As illustrated in FIG. 14, an input line and an output line of the coma free coil 20 are wired symmetrically in the right/left direction from the center line dividing the upper and lower side coma free coils 20 and 21 symmetrically in the right/left direction, and thus the length sum of a right side wire L4 and a left side wire L5 is equal to L2.

In order to easily extend the wires, hooking units h are formed at predetermined peripheral regions where the coma free coils 20 and 21 are installed. A wiring path and wiring length are varied and controlled by winding or hooking the wires on the hooking units h. The hooking units h can be provided in a plural number at the right and left sides to easily vary and control the wiring path and length.

In addition, both side wires need not to be essentially symmetrically wired in the same length. That is, the upper and lower side coma free coils 20 and 21 should have the identical wiring length to normally perform the YH compensation.

Figure 15:
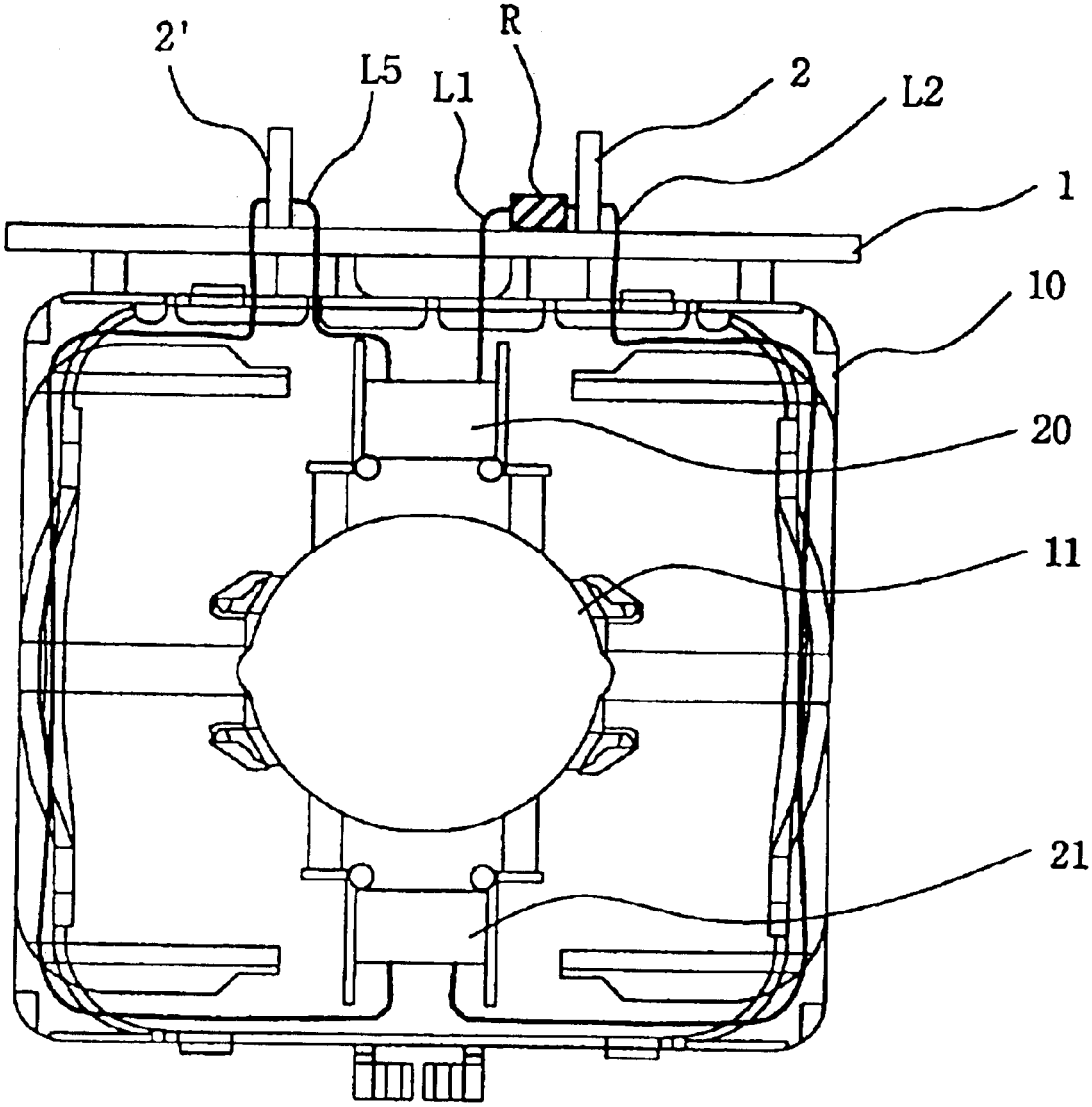
FIG. 15 is a schematic diagram illustrating a wiring structure for inserting a resistor into coma free coils and connection terminals of a printed circuit board to compensate mis-convergence in the deflection yoke in accordance with a third embodiment of the present invention.

FIG. 15 is a schematic diagram illustrating a wiring structure for serially connecting a resistor R having a resistance value corresponding to wiring length difference to one side line L1 of the coma free coil 20 to compensate resistance difference due to the wiring length difference in accordance with a third embodiment of the present invention, instead of compensating mis-convergence by equalizing the wiring length of the coma free coils 20 and 21 as shown in FIGS. 13 and 14. Preferably, the resistor R is mounted on the printed circuit board 1.

In this embodiment, the resistance value corresponding to the wiring length difference is measured to be 0.07 Ω. When the resistor of 0.07 Ω is installed, resistance can be controlled by connecting resistors having a greater resistance value than the resistor in parallel. Installation of the resistor of 0.07 Ω is easily understood by those skilled in the art to which the present invention pertains, and thus detailed explanations thereof are omitted.

In accordance with the present invention, YHC is measured after equalizing the wiring length or resistance of the coma free coils 20 and 21 and controlling YH volume.

TABLE 2

| | | | | | | | |
|---|---|---|---|---|---|---|---|
| YH | −0.20 | −0.15 | −0.05 | 0 | 0.05 | 0.15 | 0.20 |
| YH(upper) | −0.20 | −0.15 | −0.05 | 0 | 0.05 | 0.15 | 0.20 |
| YH(lower) | −0.20 | −0.15 | −0.05 | 0 | 0.05 | 0.15 | 0.20 |
| YHC | 0 | 0 | 0 | 0 | 0 | 0 | 0 |

As shown in Table 2, when YH distortion is compensated, YH (upper) and YH (lower) are identically varied, and thus YHC which implies unbalance at the upper and lower sides is not generated. That is, when YH (upper) is −0.20, YH (lower) is compensated by −0.20. Accordingly, the upper and lower side unbalance shows '0', and thus YH becomes an average of the upper and lower sides, namely −0.20.

The deflection yoke for compensating mis-convergence compensates an error generated due to upper and lower side control unbalance during the YH compensation circuit operation by equalizing the resistance values of the upper and lower side coma free coils which are different due to the wiring length difference. In addition, efficiency and quality of products can be improved and expenses can be cut down by simplifying the whole operations by overcoming the unbalance.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A deflection yoke for compensating mis-convergence, comprising:

a coil separator, a printed circuit board being positioned at one side of a rear cover unit of which;

deflection coils installed respectively on the inner and outer circumferences of the coil separator, for generating magnetic fields to deflect electron beams irradiated from a cathode ray tube;

ferrite cores installed on the outer surface of the coil separator for enhancing the magnetic fields of the deflection coils; and coma free coils for compensating mis-convergence generated due to length difference of both side wires by extending the wire connected between one side coma free coil adjacent to connection terminals of the printed circuit board and the connection terminals to have the same length as the wire connected between the other side coma free coil installed to face said one side coma free coil at a predetermined distance and the connection terminals.

2. The deflection yoke of claim 1, wherein, in order to equalize length of the wires between the connection terminals and both side coma free coils, one side line of the coma free coil adjacent to the connection terminals of the printed circuit board is wired to the corresponding connection terminal at a short distance, and the other side line of the coma free coil is wired to the corresponding connection terminal at a long distance by passing a bobbin of the facing coma free coil.

3. The deflection yoke of claim 1, wherein, in order to equalize length of the wires between the connection terminals and both side coma free coils, both side input/output wires of the coma free coil adjacent to the connection terminals of the printed circuit board are extended and wired at the same time.

4. The deflection yoke of claim 1, wherein hooking units are formed symmetrically in the right/left direction at predetermined peripheral regions on which the coma free coils are mounted from a center extension line vertically dividing the coma free coils into two, and the wires are wound around the hooking units, whereby both side wires are symmetrical.

5. The deflection yoke of claim 4, wherein at least one hooking unit is formed at one side of the symmetrical sides.

6. A deflection yoke for compensating mis-convergence, comprising:

a coil separator, a printed circuit board being positioned at one side of a rear cover unit of which;

deflection coils installed respectively on the inner and outer circumferences of the coil separator, for generating magnetic fields to deflect electron beams irradiated from a cathode ray tube;

ferrite cores installed on the outer surface of the coil separator for enhancing the magnetic fields of the deflection coils; and coma free coils for serially connecting a resistor having a resistance value corresponding to length difference of a wire connected between one side coma free coil adjacent to connection terminals of the printed circuit board and the connection terminals and a wire connected between the other side coma free coil installed to face said one side coma free coil at a predetermined distance and the connection terminals to compensate mis-convergence generated due to length difference of the wires.

7. The deflection yoke of claim 6, wherein the resistor is mounted on the printed circuit board.

8. The deflection yoke of claim 6, wherein the resistance value of the resistor is 0.07 Ω.

* * * * *

UNITED STATES PATENT AND TRADEMARK OFFICE

CERTIFICATE OF CORRECTION

PATENT NO. : 6,794,969 B2
APPLICATION NO. : 10/409383
DATED : September 21, 2004
INVENTOR(S) : Chan S. Kim et al.

It is certified that error appears in the above-identified patent and that said Letters Patent is hereby corrected as shown below:

Title Page, item [73]
In The Assignee:

Please delete "Samsung Electro-Machanics Co., Ltd.," and substitute
-- Samsung Electro-Mechanics Co., Ltd. --.

Signed and Sealed this

First Day of May, 2007

JON W. DUDAS
*Director of the United States Patent and Trademark Office*